US011783795B1

(12) United States Patent
Yen et al.

(10) Patent No.: US 11,783,795 B1
(45) Date of Patent: Oct. 10, 2023

(54) GATE DRIVER AND RELATED OUTPUT VOLTAGE CONTROL METHOD

(71) Applicant: NOVATEK Microelectronics Corp., Hsin-Chu (TW)

(72) Inventors: Ying-Chieh Yen, Hsinchu (TW); Po-Chiang Hsu, Hsinchu (TW); Ching-Hao Lee, Tainan (TW); Cheng-Hsun Tsai, New Taipei (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 17/894,122

(22) Filed: Aug. 23, 2022

(30) Foreign Application Priority Data

May 24, 2022 (TW) ..... 111119239

(51) Int. Cl.
*G09G 3/36* (2006.01)

(52) U.S. Cl.
CPC ... *G09G 3/3677* (2013.01); *G09G 2310/0291* (2013.01); *G09G 2330/025* (2013.01); *G09G 2330/06* (2013.01)

(58) Field of Classification Search
CPC ..... G09G 3/36; G09G 3/3611; G09G 3/3614; G09G 3/3622; G09G 3/3625; G09G 3/364; G09G 3/3644; G09G 3/3648; G09G 3/3674; G09G 3/3677; G09G 3/3681; G09G 3/3685; G09G 3/3688; G09G 3/3692; G09G 3/3696; G09G 2310/0291; G09G 2310/066
USPC ..... 345/87–104
See application file for complete search history.

(56) References Cited

U.S. PATENT DOCUMENTS

2009/0231319 A1 9/2009 Tsuchi
2009/0278590 A1* 11/2009 Chang ..... G09G 3/3696 327/434
2012/0280965 A1* 11/2012 Lee ..... G09G 3/3696 345/212
2014/0111718 A1* 4/2014 Chen ..... G02F 1/133 349/39
2015/0194115 A1 7/2015 Tsuchi
2016/0155406 A1* 6/2016 Lee ..... G09G 3/3659 345/212
2016/0196792 A1* 7/2016 Tomiyoshi ..... G09G 3/3696 345/94
2017/0032760 A1 2/2017 Shimomaki
2020/0294437 A1 9/2020 Tsuchi
2020/0342829 A1 10/2020 Kim

FOREIGN PATENT DOCUMENTS

CN 113257200 A 8/2021

* cited by examiner

*Primary Examiner* — Amit Chatly
*Assistant Examiner* — Nelson Lam
(74) *Attorney, Agent, or Firm* — Winston Hsu

(57) ABSTRACT

A gate driver for a panel, wherein the gate driver comprises at least an output channel unit, each of the output channel unit includes a first driving unit; a second driving unit; a first current limit circuit, coupled to the first driving unit, configured to control an output current according to an output voltage of the gate driver to limit an output current slew rate of the gate driver; and a second current limit circuit, coupled to the second driving unit, configured to control the output current according to the output voltage of the gate driver to limit the output current slew rate of the gate driver.

20 Claims, 13 Drawing Sheets

GATE DRIVER AND RELATED OUTPUT VOLTAGE CONTROL METHOD

BACKGROUND OF THE INVENTION

1. Field of the Invention

The present invention relates to a gate driver and a related output voltage control method, and more particularly, to a gate driver and a related output voltage control method capable of reducing an output voltage and a current slew rate of the gate driver.

2. Description of the Prior Art

A gate driver of a driving integrated circuit (IC) of a conventional liquid-crystal display (LCD) usually adopts Metal-Oxide-Semiconductor Field-Effect Transistor (MOSFET) switches to drive GOA (Gate on Array) circuits and multiplexers on the panel, which can easily adjust a driving ability. However, when the MOSFET switch is turned on, the MOSFET switch is switched from open (e.g. equivalent to a degree more than millions of ohm) to be conducted (e.g. equivalent to a degree under of thousands of ohm), an instantaneous peak current is generated due to a sudden change of resistance, and the instantaneous peak current is utilized for charging or discharging resistor-capacitor loops on the panel to turn on/off the switches on the panel.

According to electromagnetic wave theory, source, path and antenna are three critical factors to generate electromagnetic waves. The above instantaneous peak current provides the source, the resistor-capacitor loops from the IC to the panel provide the path, and a stacking structure of the panel provides a resonator for the antenna, the electromagnetic waves are therefore generated and emitted around the panel, which generates issues of electromagnetic interference and affects the communication bands.

Therefore, improvements are necessary to the prior art.

SUMMARY OF THE INVENTION

Therefore, the present invention provides a gate driver and a related output voltage control method to limit an output current of the gate driver, and to reduce an output slew rate and a peak current slew rate of the gate driver.

An embodiment of the present invention discloses a gate driver for a panel, wherein the gate driver comprises at least an output channel unit, each of the output channel unit comprises a first driving unit; a second driving unit; a first current limit circuit, coupled to the first driving unit, configured to control an output current according to an output voltage of the gate driver to limit an output current slew rate of the gate driver; and a second current limit circuit, coupled to the second driving unit, configured to control the output current according to the output voltage of the gate driver to limit the output current slew rate of the gate driver.

Another embodiment of the present invention discloses a gate driver, for a panel, wherein the gate driver comprises at least an output channel unit, each of the output channel unit comprises a first driving unit; a second driving unit; and a current limit circuit, respectively coupled to the first driving unit and the second driving unit via a first switch and a second switch, configured to control an output current of the gate driver according to an output voltage of the gate driver, such that the first driving unit and the second driving unit are equally controlled to limit an output current slew rate of the gate driver.

Another embodiment of the present invention discloses an output voltage control method, for a gate driver of a panel, wherein the gate driver comprises at least an output channel unit, each of the output channel unit comprises a first driving unit, a second driving unit, a first current limit circuit and a second current limit circuit, the output voltage control method comprises controlling an output current of the gate driver according to an output voltage of the gate driver to limit an output current slew rate of the gate driver Another embodiment of the present invention discloses an output voltage control method, for a gate driver of a panel, wherein the gate driver comprises at least an output channel unit, each of the output channel unit comprises a first driving unit, a second driving unit and a current limit circuit, the output voltage control method comprises controlling an output current of the gate driver according to an output voltage of the gate driver, such that the first driving unit and the second driving unit are equally controlled to limit an output current slew rate of the gate driver.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
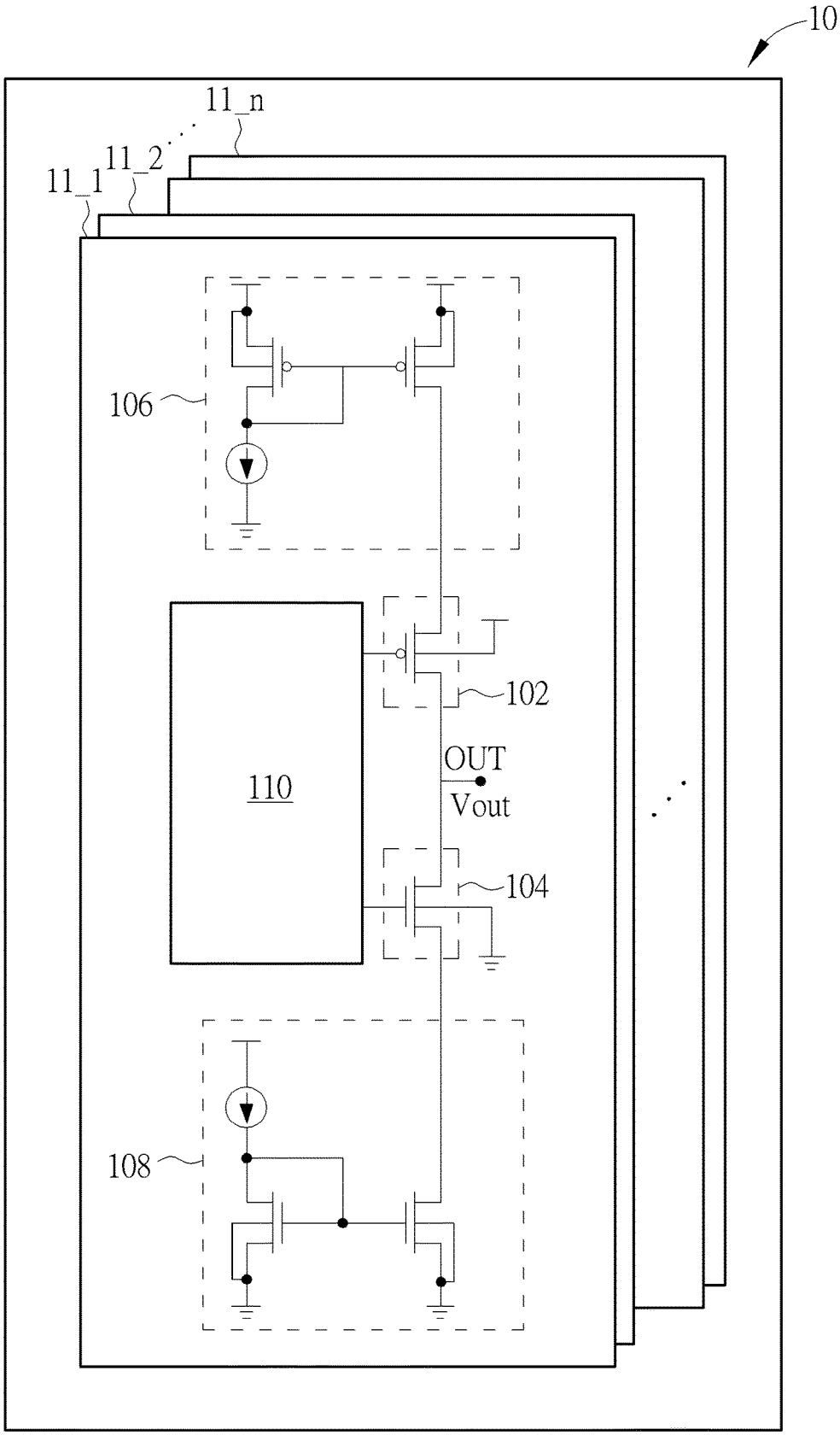
FIG. 1 is a schematic diagram of a gate driver according to an embodiment of the present invention.

Please refer to FIG. 1, which is a schematic diagram of a gate driver 10 according to an embodiment of the present invention. The gate driver 10 includes at least an output channel unit 11_1, 11_2 . . . **11_*n*, each output channel unit 11_1, 11_2 . . . 11_*n* includes a first driving unit 102, a second driving unit 104, a first current limit circuit 106 and a second current limit circuit 108. The gate driver 10 may be utilized on a panel of a liquid-crystal display (LCD), for performing charging or discharging loadings, e.g. resistors or capacitor circuits on the panel. The first driving unit 102** and the second driving unit 104 may be respectively a switch of a gate output control circuit 110, e.g. a Metal-Oxide-Semiconductor Field-Effect Transistor (MOSFET) switch, in FIG. 1, the first driving unit 102 is a P-type MOSFET switch, the second driving unit 104 is an N-type MOSFET switch.

Figure 2:
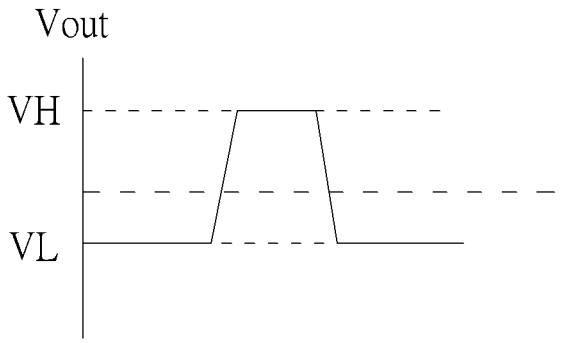
FIG. 2 is a schematic diagram of an output voltage of the gate driver according to an embodiment of the present invention.

An output voltage Vout of an output terminal OUT of each output channel unit 11_1, 11_2 . . . **11_*n* of the gate driver 10 varies between a first voltage VL and a second voltage VH, as shown in FIG. 2, to charge or discharge the loadings on the panel, wherein the first driving unit 102 (i.e. the P-type MOSFET switch) is utilized for outputting the second voltage VH, the second driving unit 104 (i.e. the N-type MOSFET switch) is utilized for outputting the first voltage VL. The first current limit circuit 106 may be a P-type current mirror, configured to control an output current VH current of each output channel unit 11_1, 11_2 . . . 11_*n* of the gate driver 10, according to the output voltage Vout of each output channel unit 11_1, 11_2 . . . 11_*n* of the gate driver 10 to limit an output current slew rate of the gate driver 10. The second current limit circuit 108 may be an N-type current mirror, configured to control an output current VL current of each output channel unit 11_1, 11_2 . . . 11_*n* of the gate driver 10, according to the output voltage Vout of each output channel unit 11_1, 11_2 . . . 11_*n* of the gate driver 10 to limit the output current slew rate of the gate driver 10**.

In other words, when the output voltage Vout of one of the output channel units 11_1, 11_2 . . . **11_*n* of the gate driver 10 is varied from the first voltage VL to the second voltage VH, the first current limit circuit 106 can limit a highest output current of the output current VH current to limit the output current slew rate of the gate driver 10; in contrast, when the output voltage Vout of the gate driver 10 is varied from the second voltage VH to the first voltage VL, the second current limit circuit 108 may limit a highest output current of the output current VL current to limit the output current slew rate of the gate driver 10. Therefore, the gate driver 10 according to an embodiment of the present invention can limit the output current slew rate of the gate driver 10 by the first current limit circuit 106 and the second current limit circuit 108**.

Figure 3:
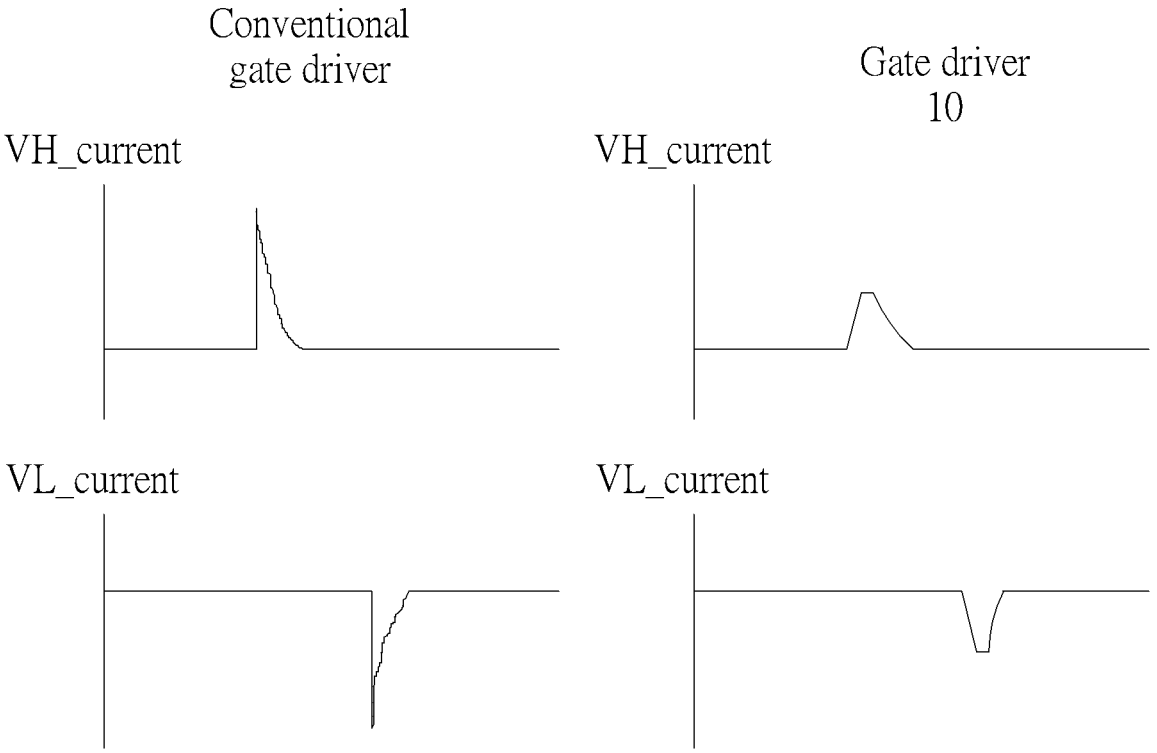
FIG. 3 is a schematic diagram of a comparison of an output current slew rate of the gate driver according to an embodiment of the present invention versus a conventional technique.

As shown in FIG. 3, compared to a current slew rate of the conventional gate driver, a larger peak current is generated when ascending or descending, the current slew rate of the gate driver according to the present invention is smaller when the output voltage Vout is varied from the first voltage VL to the second voltage VH; similarly, the current slew rate of the gate driver 10 according to the present invention is smaller that of the conventional gate driver, when the output voltage Vout is varied from the second voltage VH and the first voltage VL.

Figure 4:
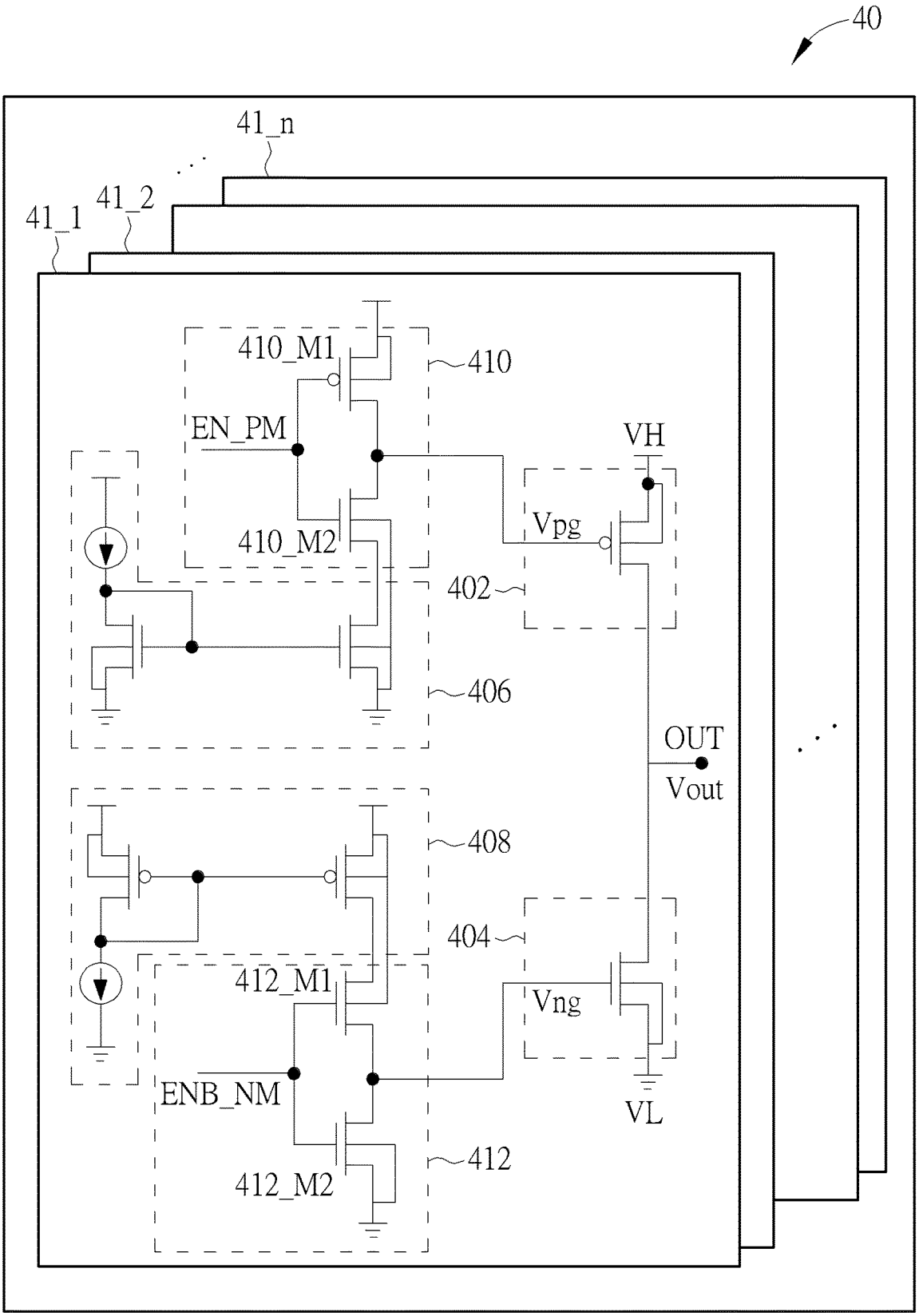
FIG. 4 to FIG. 5 are schematic diagrams of another gate driver according to an embodiment of the present invention.

In another embodiment, FIG. 4 is a schematic diagram of a gate driver 40 according to an embodiment of the present invention. The gate driver 40 includes at least one of output channel unit 41_1, 41_2 . . . **41_*n*, each output channel unit 41_1, 41_2 . . . 41_*n* includes a first driving unit 402, a second driving unit 404, a first current limit circuit 406, a second current limit circuit 408, a first previous-stage buffer 410 and a second previous-stage buffer 412. The gate driver 40 may be one of variations of the embodiment of the gate driver 10. The gate driver 40 may be utilized on a panel of a liquid-crystal display (LCD), for performing charging or discharging loadings, e.g. resistors or capacitor circuits on the panel. The first driving unit 402 and the second driving unit 404 of each output channel unit 41_1, 41_2 . . . 41_*n* of the gate driver 40 may respectively be a transistor. In the embodiment of FIG. 4, the first driving unit 402 is a P-type MOSFET switch, the second driving unit 404 is an N-type MOSFET switch. The first current limit circuit 406 may be an N-type current mirror; the second current limit circuit 408 may be a P-type current mirror. Different to the gate driver 10, each output channel unit 41_1, 41_2 . . . 41_*n* of the gate driver 40 further includes the first previous-stage buffer 410 and the second previous-stage buffer 412, wherein the first previous-stage buffer 410 further includes driving switches 410_M1, 410_M2 for slowing down a voltage descending slope of an output voltage Vout of the output channel units 41_1, 41_2 . . . 41_*n* with the first previous-stage buffer 410 to limit the output current slew rate of each output channel unit 41_1, 41_2 . . . 41_*n* of the gate driver 40. The second previous-stage buffer 412 further includes driving switches 412_M1, 412_M2, for slowing down a voltage ascending slope of the output voltage Vout of each output channel unit 41_1, 41_2 . . . 41_*n* of the gate driver 40 with the second previous-stage buffer 412 to limit the output current slew rate of the gate driver 40**.

Since the output voltage Vout of each output channel unit 41_1, 41_2 . . . **41_*n* of the gate driver 40 is varied between the first voltage VL and the second voltage VH, as shown in FIG. 2, to charge and discharge the loadings on the panel, the first driving unit 402 (i.e. the P-type MOSFET switch) may be utilized for outputting the second voltage VH, and the second driving unit 404 (i.e. the N-type MOSFET switch) may be utilized for outputting the first voltage VL. Therefore, when the output voltage Vout of each output channel unit 41_1, 41_2 . . . 41_*n* of the gate driver 40 is raised from the first voltage VL to the second voltage VH, the first driving unit 402 is activated to pull a high voltage VGH of a gate terminal Vpg to a low voltage VGL, and the first current limit circuit 406 of the output channel units 41_1, 41_2 . . . 41_*n* may limit a pull-low ability of the gate terminal Vpg of the first previous-stage buffer 410, such that the first driving unit 402 cannot be turned on too quickly, which reduces the voltage descending slope of the gate terminal Vpg and limits a charging peak current slew rate of the first driving unit 402**.

Similarly, when the output voltage Vout of each output channel unit 41_1, 41_2 . . . **41_*n* of the gate driver 40 is pulled from the second voltage VH to the first voltage VL, the second driving unit 404 is activated, a gate terminal Vng of the second driving unit 404 is pulled from the low voltage VGL to the high voltage VGH, the second current limit circuit 408 of each output channel unit 41_1, 41_2 . . . 41_*n* of the gate driver 40 may limit a pull-high ability of the second previous-stage buffer 412, such that the second driving unit 404 cannot be turned on too quickly, which reduces the voltage ascending slope of the gate terminal Vng and limits a charging peak current slew rate of the second driving unit 404**.

Figure 5:
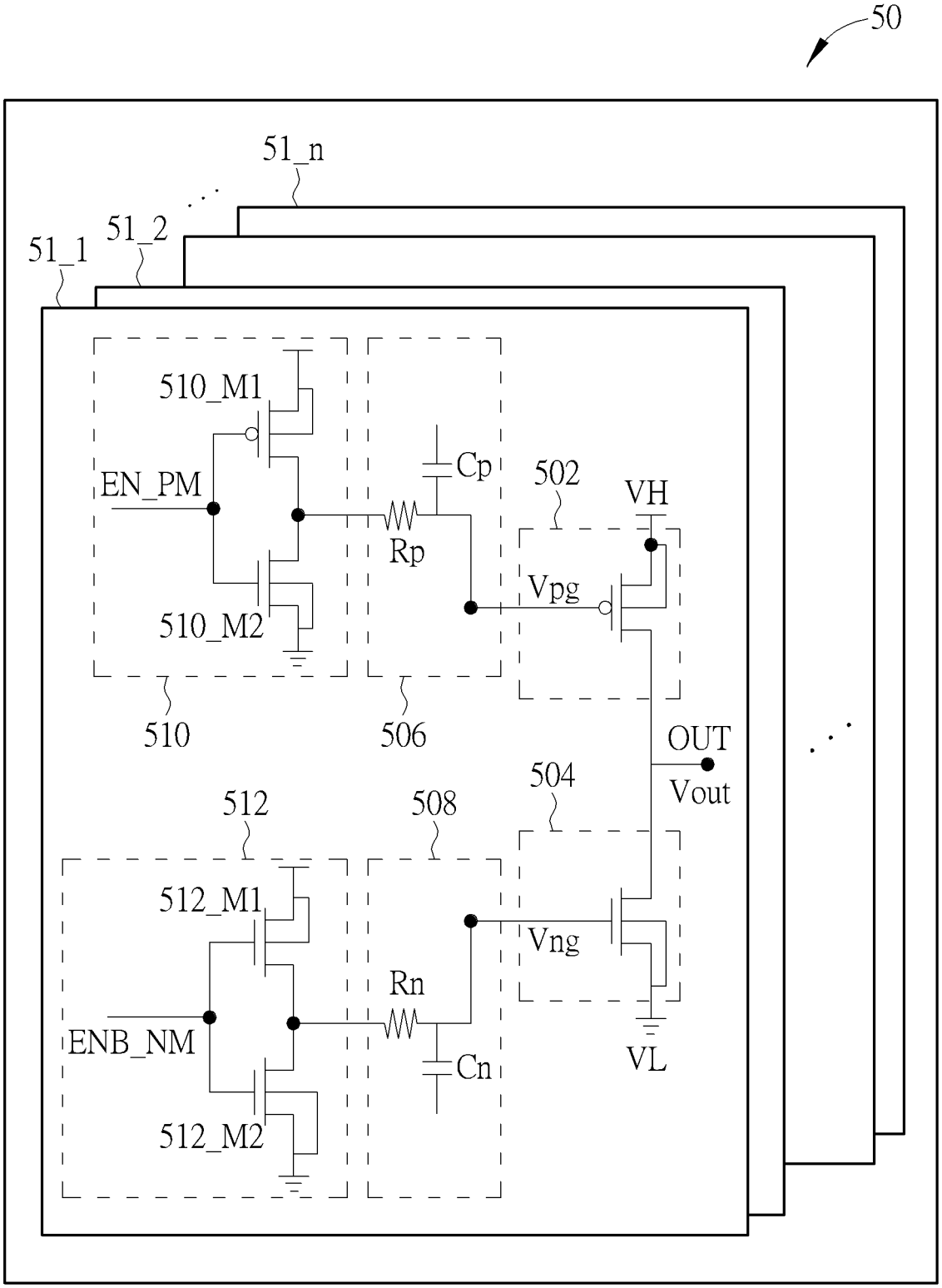

In another embodiment, please refer to FIG. 5, which is a schematic diagram of a gate driver 50 according to an embodiment of the present invention. The gate driver 50 may be one of alternative embodiments of the gate driver 10. The gate driver 50 includes at least one of output channel unit 51_1, 51_2 . . . **51_*n*, each output channel unit 51_1, 51_2 . . . 51_*n* includes a first driving unit a first driving unit 502, a second driving unit 504, a first passive circuit 506, a second passive circuit 508, a first previous-stage buffer 510 and a second previous-stage buffer 512. The gate driver 50 may be utilized on a panel of a liquid-crystal display (LCD), for performing charging or discharging loadings, e.g. resistors or capacitor circuits on the panel. The first driving unit 502 and the second driving unit 504 may respectively be a switch. In the embodiment of FIG. 5, the first driving unit 502 is a P-type MOSFET switch and the second driving unit 504 is an N-type MOSFET switch. Different to the gate driver 10, each output channel unit 51_1, 51_2 . . . 51_*n* of the gate driver 50 further includes the first passive circuit 506 and the second passive circuit 508, wherein the first passive circuit 506 may be a resistor-capacitor circuit with a resistor Rp and a capacitor Cp for slowing down a voltage descending slope of the output voltage Vout of the output channel units 51_1, 51_2 . . . 51_*n* with the first previous-stage buffer 510 to limit the output current slew rate of the gate driver 50. The second passive circuit 508 may be a resistor-capacitor circuit with a resistor Rn and a capacitor Cn for slowing down a voltage ascending slope of the output voltage Vout of the output channel units 51_1, 51_2 . . . 51_*n* with the second previous-stage buffer 512 to limit the output current slew rate of the gate driver 50**.

In other words, the first passive circuit 506 of each output channel unit 51_1, 51_2 . . . **51_*n* of the gate driver 50 may limit a pull-low ability of the first previous-stage buffer 510, such that the first driving unit 502 cannot be turned on too quickly, which reduces a voltage descending slope of a gate terminal Vpg and limits a charging peak current slew rate of the first driving unit 502. Similarly, the second passive circuit 508 of each output channel unit 51_1, 51_2 . . . 51_*n* of the gate driver 50 may limit a pull-high ability of the second previous-stage buffer 512, such that the second driving unit 504 cannot be turned on too quickly, which reduces the voltage ascending slope of a gate terminal Vng and limits a charging peak current slew rate of the second driving unit 504**.

Figure 6:
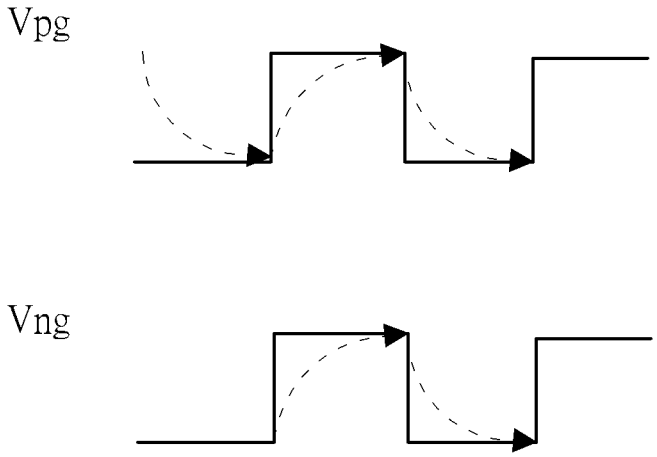
FIG. 6 is a schematic diagram of a comparison of a variation trend of voltages of a driving unit according to an embodiment of the present invention versus a conventional technique.

FIG. 6 illustrates a voltage variation trend of the gate terminal Vpg and the gate terminal Vng. Solid lines in FIG. 6 illustrate voltages of the gate terminal Vpg and the gate terminal Vng without the first passive circuit 506, the second passive circuit 508, dash lines in FIG. 6 illustrate voltages of the gate terminal Vpg and the gate terminal Vng of the gate driver 50 according to an embodiment of the present invention. As can be known from FIG. 6, the voltage variations of the gate terminal Vpg and the gate terminal Vng according to an embodiment of the present invention are smoother than those without the first passive circuit 506, the second passive circuit 508, and the charging peak current slew rate of corresponding driving unit is reduced.

Since the gate driver usually includes multiple output channel units, in another embodiment, different output channel units may be connected to an identical current limit circuit.

Figure 7:
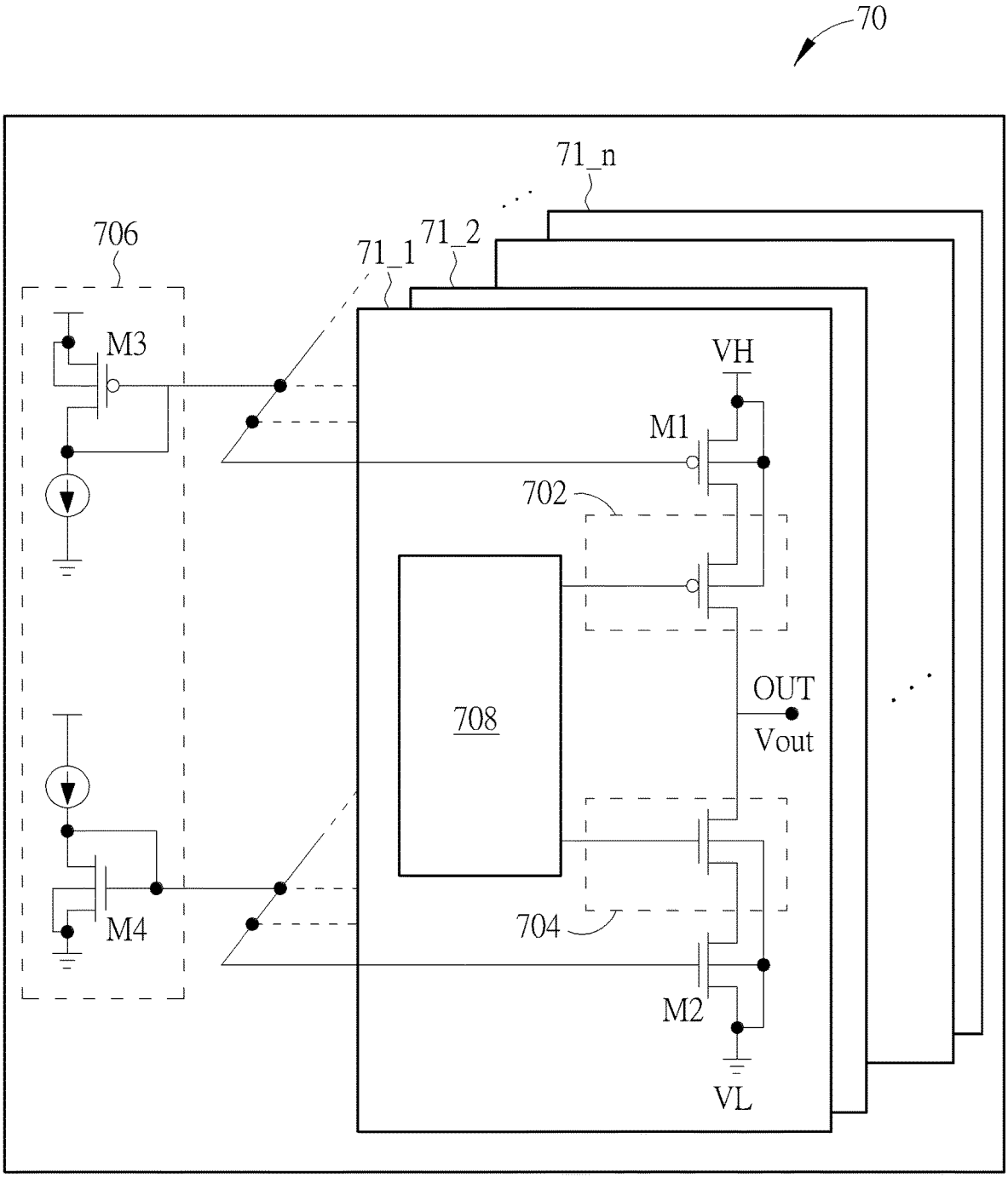
FIG. 7 to FIG. 10 are schematic diagrams of another gate driver according to an embodiment of the present invention.

Please refer to FIG. 7, which is a schematic diagram of a gate driver 70 according to an embodiment of the present invention. The gate driver 70 includes at least one of output channel unit 71_1, 71_2 . . . **71_*n*, each output channel unit 71_1, 71_2 . . . 71_*n* includes a first driving unit 702, a second driving unit 704, transistors M1, M2, a current limit circuit 706 and a gate output control circuit 708. The gate driver 70 may be utilized on a panel of a liquid-crystal display (LCD), for performing charging or discharging loadings, e.g. resistors or capacitor circuits on the panel. The first driving unit 702 may be a driving switch, the second driving unit 704 may be a driving switch, wherein the driving switch may be an MOSFET switch, the gate output control circuit 708 may control the first driving unit 702, the second driving unit 704** to determine the output voltage Vout of the output terminal OUT.

In the embodiment of FIG. 7, the first driving unit 702 is a P-type MOSFET switch, the second driving unit 704 is an N-type MOSFET switch. The current limit circuit 706 is a current mirror, which includes transistors M3, M4, and is coupled to each output channel unit 71_1, 71_2 . . . **71_*n* of the gate driver 70 in FIG. 7. Take the output channel unit 71_1 in FIG. 7 as an example, the current limit circuit 706 and the transistor M1 of the output channel unit 71_1 form a current mirror, and the current limit circuit 706 and the transistor M2 of the output channel unit 71_1 form a current mirror to limit an output current of the output channel unit 71_1 of the gate driver 70. Similarly, the output channel units 71_2 . . . 71_*n* and the current limit circuit 706 may respectively form the current mirror circuits to limit the output currents of the output channel units 71_2 . . . 71_*n* of the gate driver 70. That is, each output channel unit 71_1, 71_2 . . . 71_*n* of the gate driver 70 is connected to the current limit circuit 706 and shares the identical current limit circuit 706**.

Since the output voltage Vout of each output channel unit 71_1, 71_2 . . . **71_*n* of the gate driver 70 varies between the first voltage VL and the second voltage VH, as shown in FIG. 2, to charge or discharge the loadings on the panel, the current limit circuit 706 is configured to control the output currents VH current, VL current of each output channel unit 71_1, 71_2 . . . 71_*n* of the gate driver 70 according to the output voltage Vout of each output channel unit 71_1, 71_2 . . . 71_*n* of the gate driver 70, such that the first driving unit 702 and the second driving unit 704 of each output channel unit 71_1, 71_2 . . . 71_*n* are equally controlled to limit an output current slew rate of the gate driver 70**.

In other words, when the output voltage Vout of the output channel units 71_1, 71_2 . . . **71_*n* of the gate driver 70 is varied from the first voltage VL to the second voltage VH, the current limit circuit 706 and the transistor M1 of each output channel unit 71_1, 71_2 . . . 71_*n* may respectively forma current mirror to limit a highest output current of the output current VH current to further limit the output current slew rate of the gate driver 70; in contrast, when the output voltage Vout of the output channel units 71_1, 71_2 . . . 71_*n* of the gate driver 70 is varied from the second voltage VH to the first voltage VL, the current limit circuit 706 and the transistor M2 may be respectively form a current mirror with each output channel unit 71_1, 71_2 . . . 71_*n* to limit a highest output current of the output current VL current to further limit the output current slew rate of the gate driver 70. Therefore, the gate driver 70 can limit the output current slew rate of the gate driver 70 with the common current limit circuit 706**.

Figure 8:
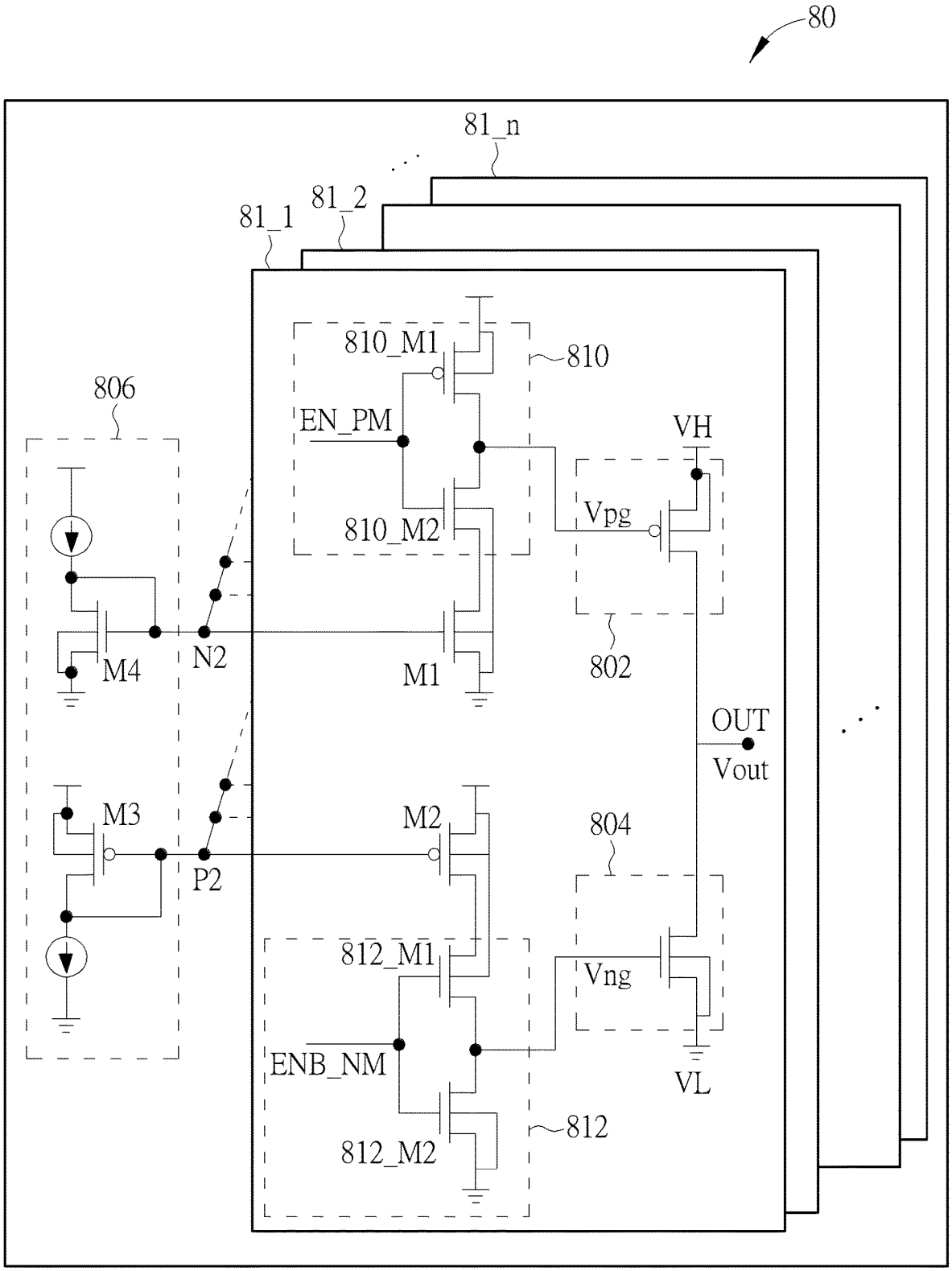

In another embodiment, FIG. 8 is a schematic diagram of a gate driver 80 according to an embodiment of the present invention. The gate driver 80 includes at least one of output channel unit 81_1, 81_2 . . . **81_*n*, each output channel unit 81_1, 81_2 . . . 81_*n* includes a first driving unit 802, a second driving unit 804, the transistors M1, M2, a current limit circuit 806, a first previous-stage buffer 810 and a second previous-stage buffer 812. The gate driver 80 may be one of alternative embodiments of the gate driver 70. The gate driver 80 may be utilized on a panel of a liquid-crystal display (LCD), for performing charging or discharging loadings, e.g. resistors or capacitor circuits on the panel. The first driving unit 802 and the second driving unit 804 may be respectively a driving switch. In the embodiment of FIG. 8, the first driving unit 802 is a P-type MOSFET switch, the second driving unit 804 is an N-type MOSFET switch. The first previous-stage buffer 810 and the second previous-stage buffer 812 may control the first driving unit 802, the second driving unit 804 to determine the output voltage Vout of the output terminal OUT. The current limit circuit 806 is a current mirror, which includes transistors M3, M4, and is coupled to the gate driver 80 in FIG. 8. In FIG. 8, the current limit circuit 806 may form a current mirror with the transistor M1 of each output channel unit 81_1, 81_2 . . . 81_*n*, and the current limit circuit 806 may form a current mirror with the transistor M2 of each output channel unit 81_1, 81_2 . . . 81_*n* to limit output currents of each output channel unit 81_1, 81_2 . . . 81_*n* of the gate driver 80. That is, each output channel unit 81_1, 81_2 . . . 81_*n* of the gate driver 80 connects to the current limit circuit 806 to share the common current limit circuit 806**.

Different to the gate driver 70, each output channel unit 81_1, 81_2 . . . **81_*n* of the gate driver 80 further includes the first previous-stage buffer 810 and the second previous-stage buffer 812**.

Take the output channel unit 81_1 as an example, the first previous-stage buffer 810 may include driving switches 810 M1, 810 M2 for slowing down a voltage descending slope of a first gate terminal Vpg of the first driving unit 802 with the current limit circuit 806 to limit the output current slew rate of the gate driver 80. The second previous-stage buffer 812 may include driving switches 812_M1, 812_M2 for slowing down a voltage ascending slope of a second gate terminal Vng of the second driving unit 804 with the current limit circuit 806 to limit the output current slew rate of the gate driver 80.

Therefore, each output channel unit 81_1, 81_2 . . . **81_*n*, connecting to an N2 node, of the gate driver 80 shares the common current limit circuit 806 to limit a pull-low ability of the first previous-stage buffer 810 of the output channel units 81_1, 81_2 . . . 81_*n* and to limit a charging peak current slew rate of the first driving unit 802 of each output channel unit 81_1, 81_2 . . . 81_*n*. Similarly, the current limit circuit 806 may limit a pull-high ability of the second previous-stage buffer 812 of the output channel units 81_1, 81_2 . . . 81_*n* connecting to a P2 node to limit a charging peak current slew rate of the second driving unit 804 of each output channel unit 81_1, 81_2 . . . 81_*n***.

Figure 9:
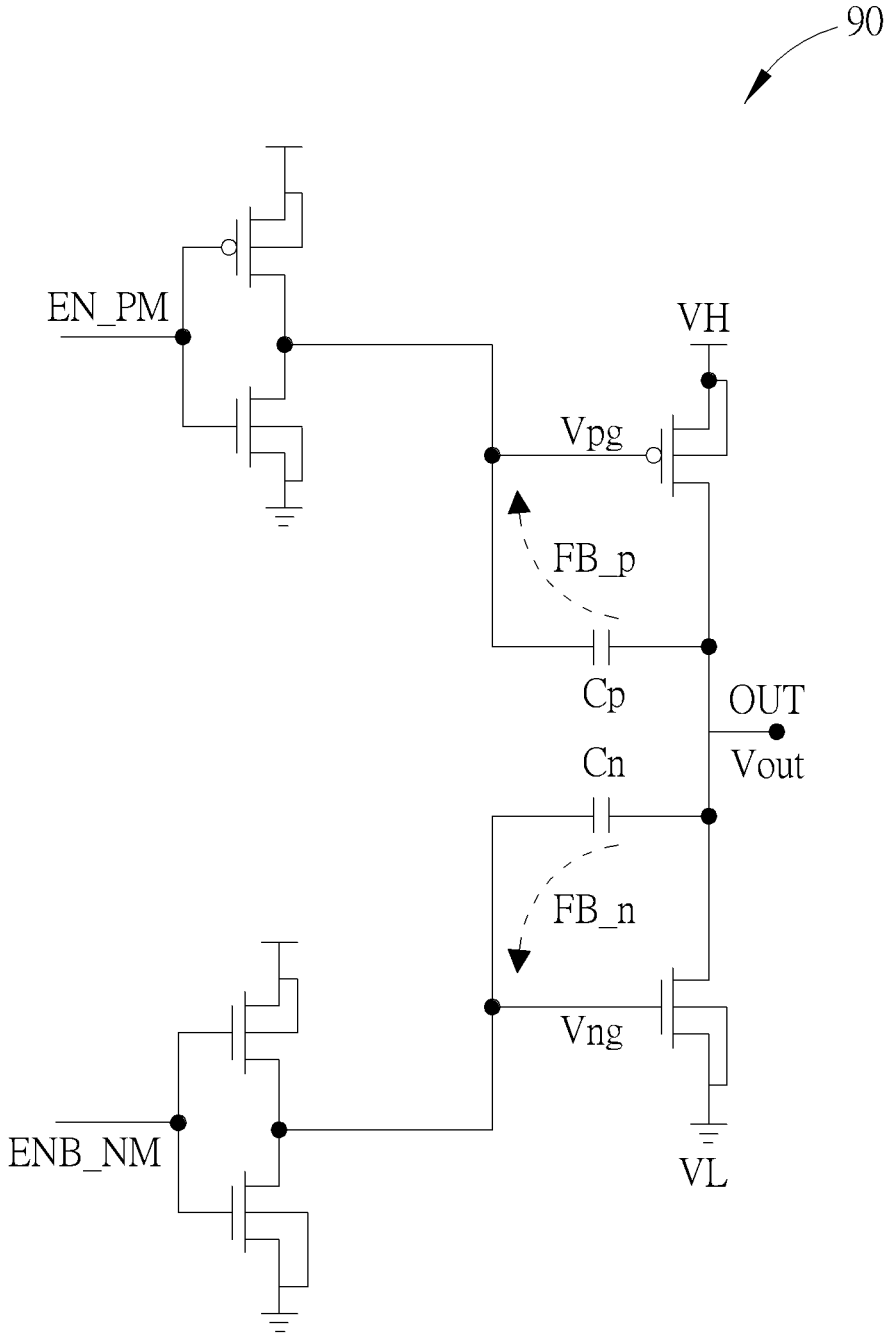

In another embodiment, feedback loop circuits may be added to the above gate drivers. Please refer to FIG. 9, which is a schematic diagram of a gate driver 90 according to an embodiment of the present invention. The gate driver 90 only illustrates an output terminal and a previous-stage buffer of the gate driver 90. As shown in FIG. 9, the output terminal of the gate driver 90 further includes capacitors Cp, Cn to form feedback loops FB p, FB n, such that when the output voltage Vout is raised from the first voltage VL to the second voltage VH, a negative feedback loop of the feedback loop FB p generates a negative suppressing signal to suppress a voltage variation slope (i.e. a voltage descending slope) of a gate terminal Vpg to reduce a peak current slew rate of the gate driver 90.

Similarly, when the output voltage Vout is reduced from the second voltage VH to the first voltage VL, a negative feedback loop of the feedback loop FB n generates a negative suppressing signal to suppress a voltage variation slope (i.e. a voltage ascending slope) of a gate terminal Vng to reduce a peak current slew rate of the output terminal of the gate driver 90.

Figure 10:
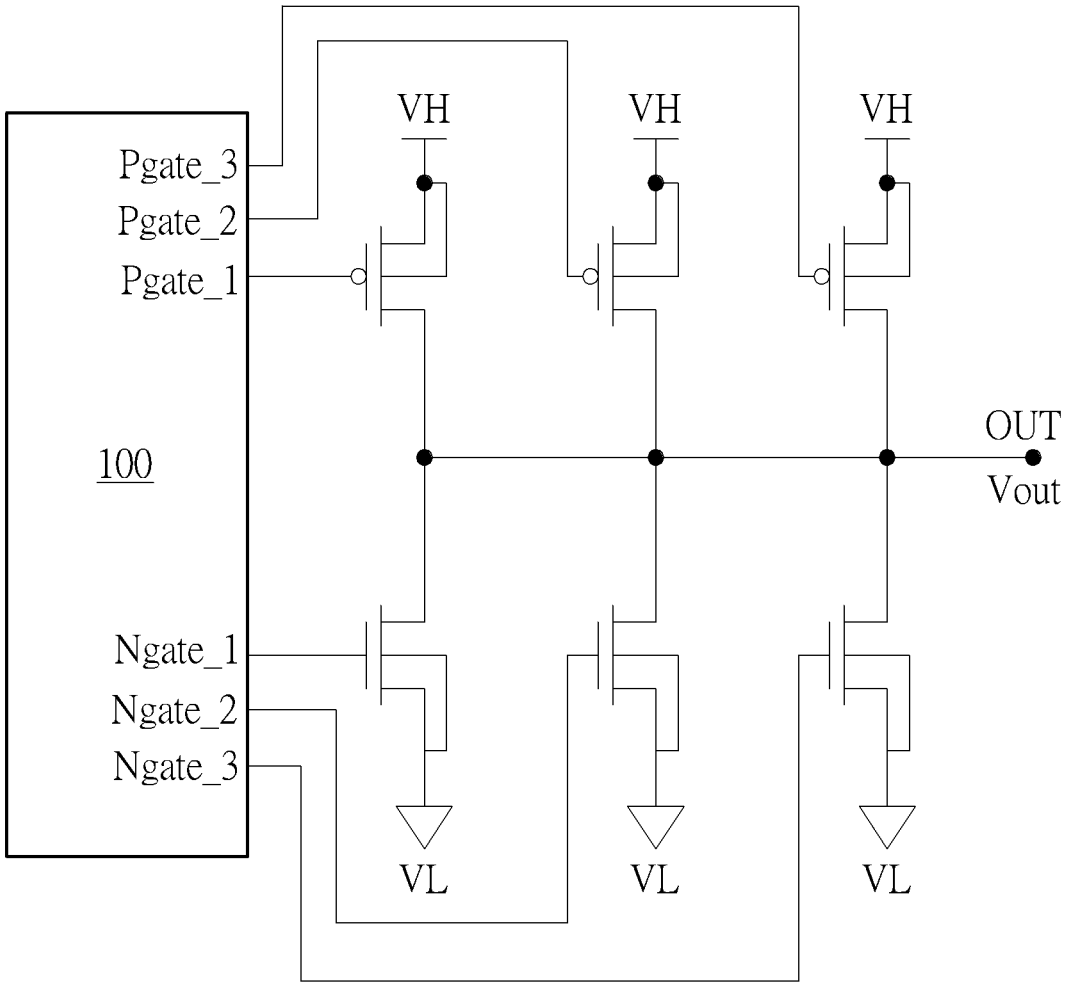

Alternatively, in another embodiment, the driving units of the gate drivers according to the embodiments of the present invention may be turned on with multiple stages. Please refer to FIG. 10, which is a schematic diagram of a gate driver 100 according to an embodiment of the present invention. FIG. 10 only illustrates an output terminal and a gate output control circuit of the gate driver 100. In FIG. 10, switches of the gate output control circuit may be implemented by multiple switches Pgate_1-Pgate_3, Ngate_1-Ngate_3 with smaller area in hardware, e.g. a ratio of implemented areas of the switches Pgate_1, Pgate_2, Pgate_3 on an IC is 1:2:3, wherein the switches Pgate_1-Pgate_3, Ngate_1-Ngate_3 may be implemented by transistors.

Figure 11:
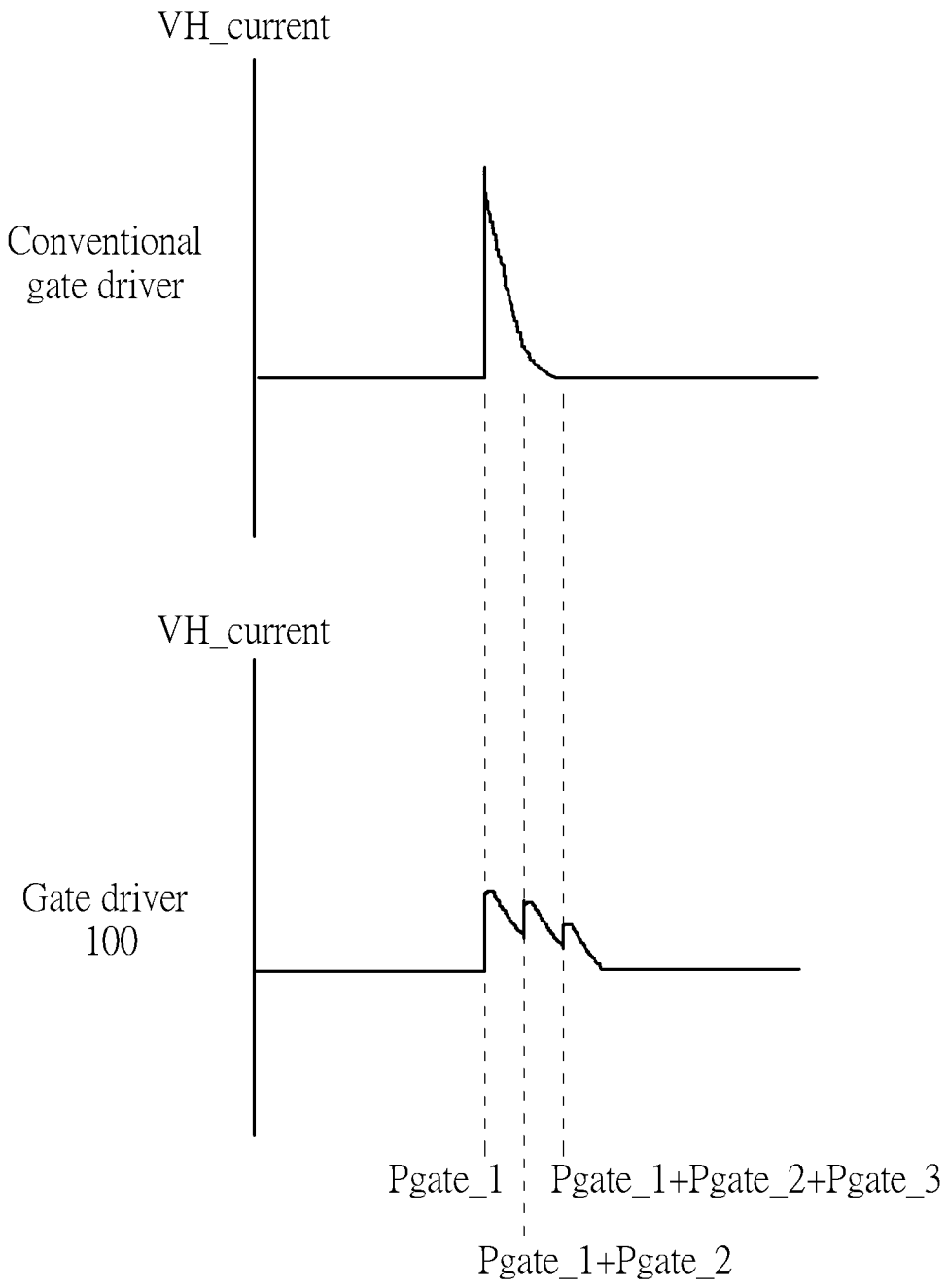
FIG. 11 is a schematic diagram of an instantaneous current of an output voltage of the gate driver according to an embodiment of the present invention.

In detail, please refer to FIG. 11, is a schematic diagram of an instantaneous current of an output current VH current of the gate driver 100 according to an embodiment of the present invention. When the output voltage Vout is varied from the first voltage VL to the second voltage VH, and the switches Pgate_1-Pgate_3 are turned on with multiple stages, the switch Pgate_1 is firstly conducted (stage 1), and then the switches Pgate_1, Pgate_2 are conducted (stage 2), and the switches Pgate_1-Pgate_3 are conducted lastly (stage 3).

Since a resistance of the switch Pgate_1 is larger when conducted, the instantaneous current is smaller, and a difference between the output voltage and a target voltage is smaller than in the stage 2 and stage 3, such that the instantaneous current is reduced. Therefore, as shown in FIG. 11, compared to a conventional switch of the gate output control circuit with only one stage, the gate driver 100 according to an embodiment of the present invention may reduce a current variation rate and a voltage output slope of the output terminal OUT, and to reduce a phenomenon of electromagnetic interference.

Similarly, when the output voltage Vout is varied from the second voltage VH to the first voltage VL, the switches Ngate_1-Ngate_3 are sequentially conducted to reduce the current variation rate and the voltage output slope of the output terminal OUT, and to reduce a phenomenon of electromagnetic interference.

In addition to the implementation of multiple switches with different areas on the IC, resistors with different resistances may be serial connected to the switches Pgate_1-Pgate_3, the switches Ngate_1-Ngate_3 to achieve the identical effects, and not limited to the above embodiment.

Compared to the conventional gate driver with a single output channel connecting two terminals of the loading of the panel, in an embodiment, a gate driver according to an embodiment of the present invention may output identical signals to the two terminals of the loading of the panel for driving, which reduces occurrence times of the instantaneous current, and reduces the electromagnetic energy.

Figure 12:
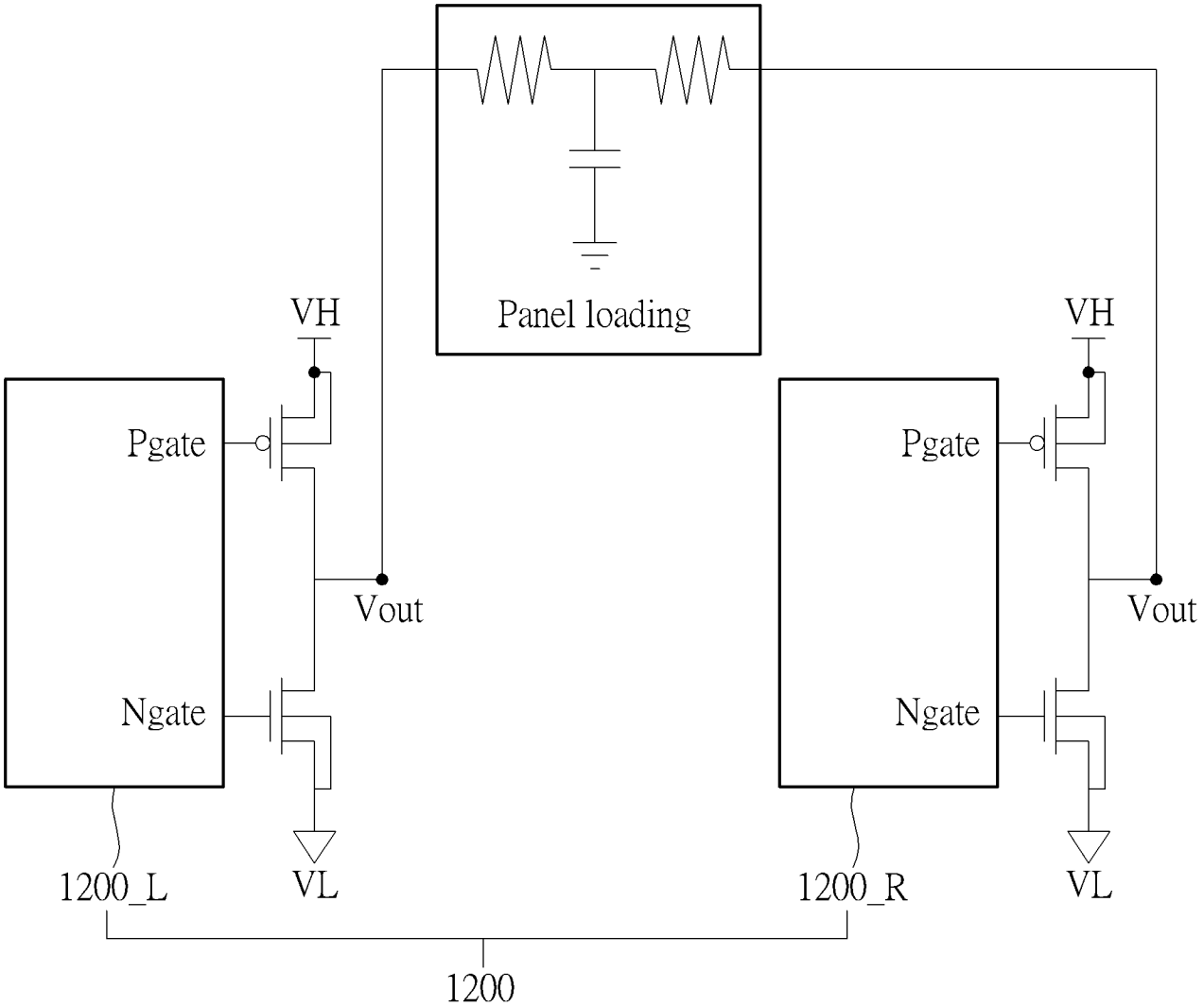
FIG. 12 is a schematic diagram of another gate driver according to an embodiment of the present invention.

Please refer to FIG. 12, which is a schematic diagram of a gate driver 1200 according to an embodiment of the present invention. The gate driver 1200 includes a left channel gate driving unit 1200_L and a right channel gate driving unit 1200_R, respectively coupled to a left side and a right side of a panel. Since the left channel gate driving unit 1200_L and the right channel gate driving unit 1200_R are activated with a time division method by the gate driver 1200 to drive the left side and the right side of the panel, a variation of an instantaneous current of the panel loading is reduced.

Figure 13:
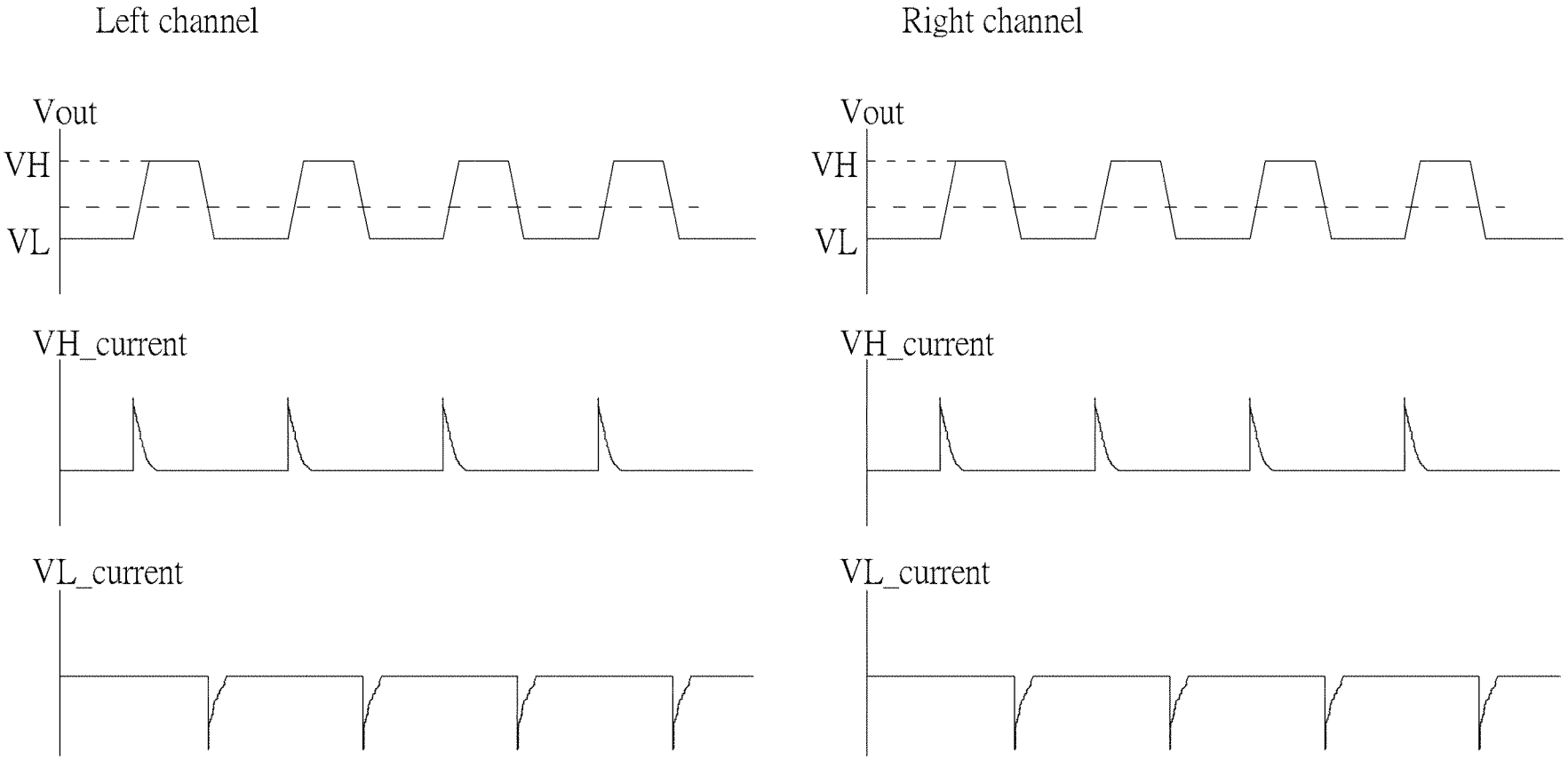
FIG. 13 is a schematic diagram output voltages and current peaks of a conventional gate driver.

Moreover, as shown in FIG. 13, eight peak currents are generated in four variation periods of the output voltage Vout of the conventional gate driver, if the two sides of the panel loading are simultaneously driven.

Figure 14:
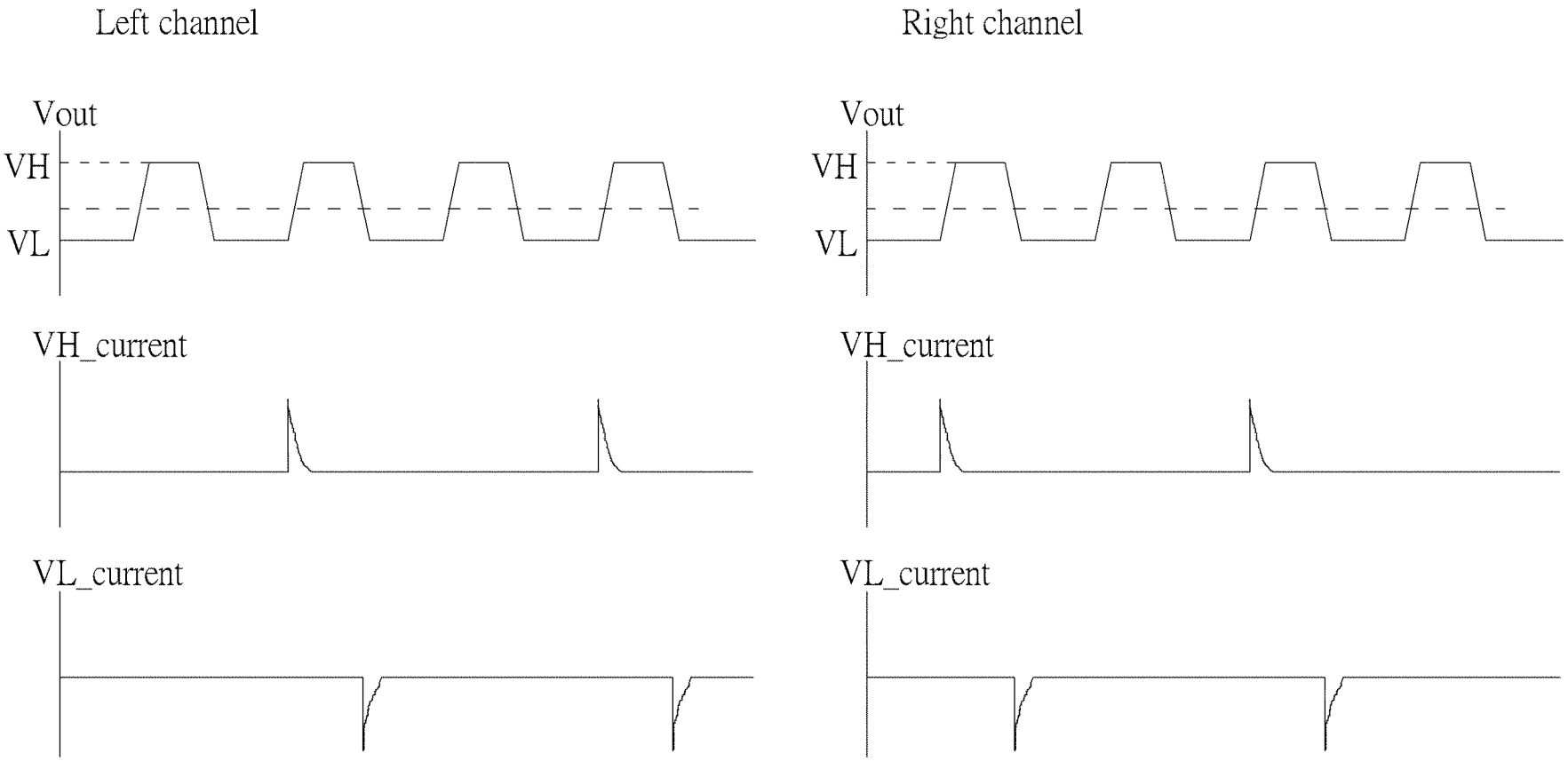
FIG. 14 is a schematic diagram of output voltages and current peaks of the gate driver according to an embodiment of the present invention.

In comparison, as shown in FIG. 14, when the left channel gate driving unit 1200_L and the right channel gate driving unit 1200_R are activated in turns to drive the panel loading, an occurrence times of the peak currents of the left channel and the right channel of the panel is reduced to four times in four variation periods of the output voltage of the gate driver 1200. In addition, an energy distribution of current is reduced and the electromagnetic energy is reduced.

In summary, the present invention provides a gate driver and a related output voltage control method, which limits an output current of the gate driver and further reduces an output slew rate and a peak current slew rate of the gate driver.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A gate driver for a panel, wherein the gate driver comprises at least an output channel unit, the output channel unit comprising:

a first driving unit;

a second driving unit;

a first current limit circuit, coupled to the first driving unit, configured to control an output current according to an output voltage of the gate driver to limit an output current slew rate of the gate driver; and a second current limit circuit, coupled to the second driving unit, configured to control the output current according to the output voltage of the gate driver to limit the output current slew rate of the gate driver;

a first previous-stage buffer, coupled between the first current limit circuit and the first driving unit, configured to slow down a voltage descending slope of the output voltage of the gate driver with the first current limit circuit to limit a first charging peak current slew rate of the first driving unit; and a second previous-stage buffer, coupled between the second current limit circuit and the second driving unit, configured to slow down a voltage ascending slope of the output voltage of the gate driver with the second current limit circuit to limit a second charging peak current slew rate of the second driving unit.

2. The gate driver of claim 1, wherein the first current limit circuit is configured to limit the output current when the output voltage of the gate driver is varied from a first voltage to a second voltage, wherein the first voltage is lower than the second voltage.

3. The gate driver of claim 1, wherein the second current limit circuit is configured to limit the output current when the output voltage of the gate driver is varied from a second voltage to a first voltage, wherein the first voltage is lower than the second voltage.

4. A gate driver for a panel, wherein the gate driver comprises at least an output channel unit, the output channel unit comprising:

a first driving unit;

a second driving unit;

a first current limit circuit, coupled to the first driving unit, configured to control an output current according to an output voltage of the gate driver to limit an output current slew rate of the gate driver; and a second current limit circuit, coupled to the second driving unit, configured to control the output current according to the output voltage of the gate driver to limit the output current slew rate of the gate driver;

a first previous-stage buffer;

a second previous-stage buffer;

a first passive circuit, coupled between the first previous-stage buffer and the first driving unit, configured to slow down a voltage descending slope of the output voltage with the first previous-stage buffer to limit the output current slew rate of the first driving unit; and a second passive circuit, coupled between the second previous-stage buffer and the second driving unit, configured to slow down a voltage ascending slope of the output voltage with the second previous-stage buffer to limit the output current slew rate of the second driving unit.

5. The gate driver of claim 4, wherein the first driving unit is a P-type Metal-Oxide-Semiconductor Field-Effect Transistor (PMOSFET) and the second driving unit is an N-type Metal-Oxide-Semiconductor Field-Effect Transistor (NMOSFET).

6. The gate driver of claim 4, wherein the first current limit circuit is configured to limit the output current when the output voltage of the gate driver is varied from a first voltage to a second voltage, wherein the first voltage is lower than the second voltage.

7. The gate driver of claim 4, wherein the second current limit circuit is configured to limit the output current when the output voltage of the gate driver is varied from a second voltage to a first voltage, wherein the first voltage is lower than the second voltage.

8. A gate driver, for a panel, wherein the gate driver comprises at least an output channel unit, the output channel unit comprising:

a first driving unit;

a second driving unit; and a current limit circuit, respectively coupled to the first driving unit and the second driving unit via a first switch and a second switch, configured to control an output current of the gate driver according to an output voltage of the gate driver, such that the first driving unit and the second driving unit are equally controlled to limit an output current slew rate of the gate driver;

a first previous-stage buffer, coupled between the current limit circuit and the first driving unit, configured to slow down a voltage descending slope of a first gate terminal of the first driving unit with the current limit circuit to limit the output current slew rate of the gate driver; and a second previous-stage buffer, coupled between the current limit circuit and the second driving unit, configured to slow down a voltage ascending slope of a second gate terminal of the second driving unit with the current limit circuit to limit the output current slew rate of the gate driver.

9. The gate driver of claim 8, wherein when the output voltage of the gate driver is varied from a first voltage to a second voltage, the current limit circuit and the first switch form a current mirror to limit the output current, wherein the first voltage is lower than the second voltage.

10. The gate driver of claim 8, wherein when the output voltage of the gate driver is varied from a second voltage to a first voltage, the current limit circuit and the second switch form a current mirror to limit the output current, wherein the first voltage is lower than the second voltage.

11. An output voltage control method, for a gate driver of a panel, wherein the gate driver comprises at least an output channel unit, the output channel unit comprises a first driving unit, a second driving unit, a first current limit circuit and a second current limit circuit, the output voltage control method comprising:

controlling an output current of the gate driver according to an output voltage of the gate driver to limit an output current slew rate of the gate driver;

wherein the gate driver further includes a first previous-stage buffer and a second previous-stage buffer, the first previous-stage buffer slows down a voltage descending slope of the output voltage of the gate driver with the first current limit circuit to limit a first charging peak current slew rate of the first driving unit and the second previous-stage buffer slows down a voltage ascending slope of the output voltage of the gate driver with the second current limit circuit to limit a second charging peak current slew rate of the second driving unit.

12. The output voltage control method of claim 11, wherein the first current limit circuit is configured to limit the output current when the output voltage of the gate driver is varied from a first voltage to a second voltage, wherein the first voltage is lower than the second voltage.

13. The output voltage control method of claim 11, wherein the second current limit circuit is configured to limit the output current when the output voltage of the gate driver is varied from a second voltage to a first voltage, wherein the first voltage is lower than the second voltage.

14. An output voltage control method, for a gate driver of a panel, wherein the gate driver comprises at least an output channel unit, the output channel unit comprises a first driving unit, a second driving unit, a first current limit circuit and a second current limit circuit, the output voltage control method comprising:

controlling an output current of the gate driver according to an output voltage of the gate driver to limit an output current slew rate of the gate driver;

wherein the gate driver further includes a first previous-stage buffer, a second previous-stage buffer, a first passive circuit and a second passive circuit, the first passive circuit and the first previous-stage buffer slow down a voltage descending slope of the output voltage to limit the output current slew rate of the first driving unit; and the second passive circuit and the second previous-stage buffer slow down a voltage ascending slope of the output voltage to limit the output current slew rate of the second driving unit.

15. The output voltage control method of claim 14, wherein the first driving unit is a P-type Metal-Oxide-Semiconductor Field-Effect Transistor (PMOSFET) and the second driving unit is an N-type Metal-Oxide-Semiconductor Field-Effect Transistor (NMOSFET).

16. The output voltage control method of claim 14, wherein the first current limit circuit is configured to limit the output current when the output voltage of the gate driver is varied from a first voltage to a second voltage, wherein the first voltage is lower than the second voltage.

17. The output voltage control method of claim 14, wherein the second current limit circuit is configured to limit the output current when the output voltage of the gate driver is varied from a second voltage to a first voltage, wherein the first voltage is lower than the second voltage.

18. An output voltage control method, for a gate driver of a panel, wherein the gate driver comprises at least an output channel unit, the output channel unit comprises a first driving unit, a second driving unit and a current limit circuit, the output voltage control method comprising:

controlling an output current of the gate driver according to an output voltage of the gate driver, such that the first driving unit and the second driving unit are equally controlled to limit an output current slew rate of the gate driver;

wherein the gate driver further includes a first previous-stage buffer and a second previous-stage buffer, the first previous-stage buffer and the current limit circuit slow down a voltage descending slope of a first gate terminal of the first driving unit to limit the output current slew rate of the gate driver; and the second previous-stage buffer and the current limit circuit slow down a voltage ascending slope of a second gate terminal of the second driving unit to limit the output current slew rate of the gate driver.

19. The output voltage control method of claim 18, wherein when the output voltage of the gate driver is varied from a first voltage to a second voltage, the current limit circuit and a first switch of the gate driver form a current mirror to limit the output current, wherein the first voltage is lower than the second voltage.

20. The output voltage control method of claim 18, wherein when the output voltage of the gate driver is varied from a second voltage to a first voltage, the current limit circuit and a second switch of the gate driver form a current mirror to limit the output current, wherein the first voltage is lower than the second voltage.

* * * * *